US006050205A

United States Patent [19]

Terao

[11] Patent Number: 6,050,205

[45] Date of Patent: Apr. 18, 2000

[54] SEWING MACHINE WITH THREAD TENSION RELEASING MECHANISM

[75] Inventor: Akira Terao, Nagoya, Japan

[73] Assignee: Brother Kogyo Kabushiki Kaisha, Nagoya, Japan

[21] Appl. No.: 09/282,209

[22] Filed: Mar. 31, 1999

[30] Foreign Application Priority Data

Mar. 31, 1998 [JP] Japan ..... 10-086978

[51] Int. Cl.[7] ..... D05B 47/00

[52] U.S. Cl. ..... 112/254

[58] Field of Search ..... 112/80.7, 241, 112/254, 255

[56] References Cited

U.S. PATENT DOCUMENTS 3,190,249 6/1965 Gegauf, Jr. ..... 112/254
3,500,781 3/1970 Peschke ..... 112/254
4,111,140 9/1978 Gonnai et al. ..... 112/254

FOREIGN PATENT DOCUMENTS 11-33257 2/1999 Japan .
839233 6/1960 United Kingdom ..... 112/254

*Primary Examiner*—Ismael Izaguirre
*Attorney, Agent, or Firm*—Oliff & Berridge, PLC

[57] ABSTRACT

A sewing machine includes a thread tension applying mechanism for applying tension to a needle thread supplied from a needle thread supply source to a sewing needle, a thread tension releasing mechanism for releasing the thread tension applying mechanism from a tension applying state, a spring for driving the thread tension releasing mechanism, a switching mechanism for switching the spring between an operative state and a non-operative state, and a drive source for driving the switching mechanism.

10 Claims, 7 Drawing Sheets

SEWING MACHINE WITH THREAD TENSION RELEASING MECHANISM

BACKGROUND OF THE INVENTION

1. Field of the Invention

This invention relates to a sewing machine including a thread tension applying mechanism for applying tension to a needle thread and a thread tension releasing mechanism for releasing the thread tension applying mechanism from a tension applying state.

2. Description of the Related Art

Sewing machines are conventionally provided with a thread tension releasing mechanism for releasing a thread tension applying mechanism from a tension applying state. The thread tension releasing mechanism comprises a can mounted on a rotational shaft of an electric motor serving as a drive source and a lever rocked by the cam. The lever is rocked so that one of thread tension discs of the thread tension applying mechanism is moved in a releasing direction to release the thread tension applying mechanism from the tension applying state. In this construction, the tension applying mechanism is provided with a thread tension spring having a large spring force. Accordingly, in order that the thread tension applying mechanism may be released against the spring force of the thread tension spring, the motor needs to have a large driving force. The can and the lever are used so that the driving force developed by the motor is rendered as small as possible. Yet, the motor of a larger driving force or a large-sized motor serving as the drive source is required. This results in an increase in the size of the sewing machine and an increase in the manufacturing cost thereof.

SUMMARY OF THE INVENTION

Therefore, an object of the present invention is to provide a sewing machine in which the size of the drive source used when the thread tension applying mechanism is released can be reduced and accordingly, the overall size of the sewing machine can be reduced.

The present invention provides a sewing machine comprising a thread tension applying mechanism for applying tension to a needle thread supplied from a needle thread supply source to a sewing needle, a thread tension releasing mechanism for releasing the thread tension applying mechanism from a tension applying state, a spring for driving the thread tension releasing mechanism, a switching mechanism for switching the spring between an operative state and a non-operative state, and a drive source for driving the switching mechanism.

According to the above-described construction, the thread tension releasing mechanism is driven by the spring, and the switching mechanism is provided for switching the spring between the operative state and the non-operative state. Further, the switching mechanism in driven by the drive source. Accordingly, a drive source developing a small driving force can be used. Since the thread tension releasing mechanism usually comprises a can and a lever, the spring force of the spring driving the thread tension releasing mechanism may be rendered smaller than the spring force of a spring of the thread tension applying mechanism. Further, since the switching mechanism switching the spring between the operative state and the non-operative state usually comprises a cam and a lever, the driving force required for driving the switching mechanism may be rendered smaller than that of a drive source in the prior art. Consequently, the size of the drive source can be reduced.

In the above-described construction, the drive source preferably comprises an electric motor or a rotary solenoid. Further, the spring is preferably rotatable and the thread tension releasing mechanism preferably comprises a pivot plate pivoted in a releasing direction by the spring and a releasing plate provided to be linked with the pivot plate so as to release the thread tension applying mechanism when the pivot plate is pivoted. In this construction, the pivot plate preferably has an end formed with a hole and the releasing plate preferably has an end inserted through the hole of the pivot plate so that the releasing plate is connected to the pivot plate.

The thread tension applying mechanism preferably comprises at least a pair of thread tension discs and the releasing plate includes a releasing plate portion brought into abutment with one of the thread tension discs to displace said one thread tension disc so that the thread tension applying mechanism is released and a connected plate portion connected to the pivot plate, the releasing plate portion and the connected plate portion being formed integrally with each other. Further, the switching mechanism preferably comprises a releasing lever linked to the pivot plate and a can brought into contact with the releasing lever and driven by the drive source, In the above-described sewing machine, an embroidering function or a function of performing a normal stitch or a zigzag stitch is selectively executed. Further, the drive source preferably serves as a drive source for rocking the sewing needle rightward and leftward. Additionally, the sewing machine preferably further comprises a lifting lever manually operated so that a presser foot pressing a piece of cloth is moved upward. In this construction, the thread tension releasing mechanism is driven in synchronization with an operation of the lifting lever.

BRIEF DESCRIPTION OF THE DRAWINGS

Other objects, advantages and features of the present invention will become clear upon reviewing the following description of the preferred embodiment, made with reference to the accompanying drawings, in which.

DETAILED DESCRIPTION OF THE PREFERRED EMBODIMENT

Figure 7:
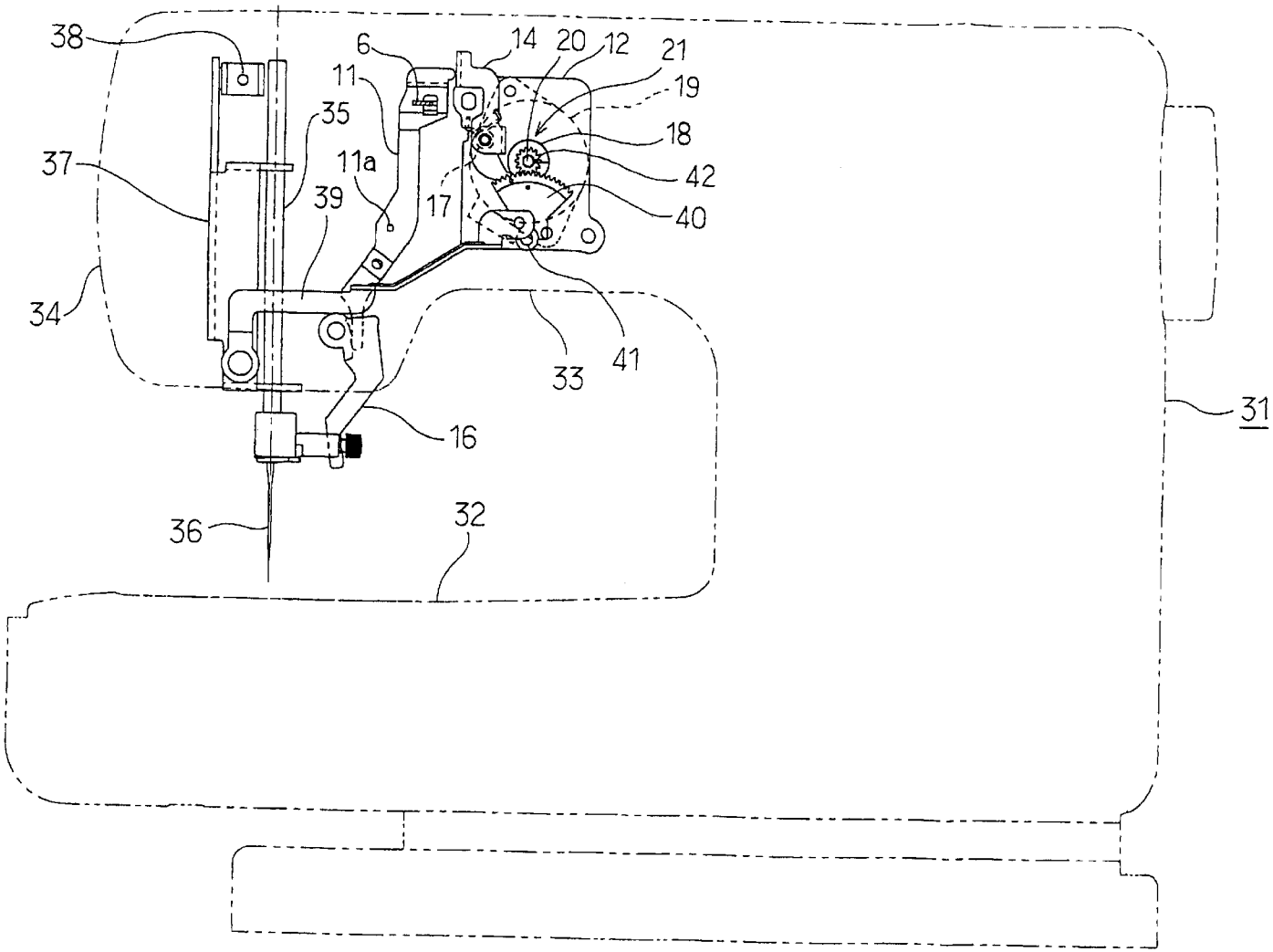
FIG. 7 is a front view of the sewing machine, showing a needle rocking mechanism.

One embodiment of the present invention will be described with reference to the accompanying drawings. In the embodiment, the invention is applied to a domestic embroidery machine. Referring first to FIG. 7, a sewing machine body 31 of the embroidery machine is schematically shown. The sewing machine body 31 comprises a sewing bed 32 and a sewing arm 33. A sewing head 34 is provided in a left-hand end of the arm 33 in FIG. 7. A needle bar 35 is provided in the head 34 so as to be vertically moved and rocked rightward and leftward. A sewing needle 36 is secured to a lower end of the needle bar 35. A well-known driving mechanism (not shown) is provided for reciprocating the needle bar 35 upward and downward. A needle bar rocking mechanism is provided for rocking the needle bar 35 rightward and leftward as will be described later. A thread tension applying mechanism 1 is eliminated in FIG. 7.

A throat plate, a feed dog, a shuttle, an embroidery frame, etc. are provided below the needle bar 35 in the sewing bed 32 although none of them are shown. This domestic embroidery machine is provided with a function of performing a normal stitch and a zigzag stitch as well as an embroidery sewing. Accordingly, the aforesaid embroidery frame and a driving mechanism for horizontally moving the embroidery frame are detachably attached to the sewing machine body 31.

Figure 1:
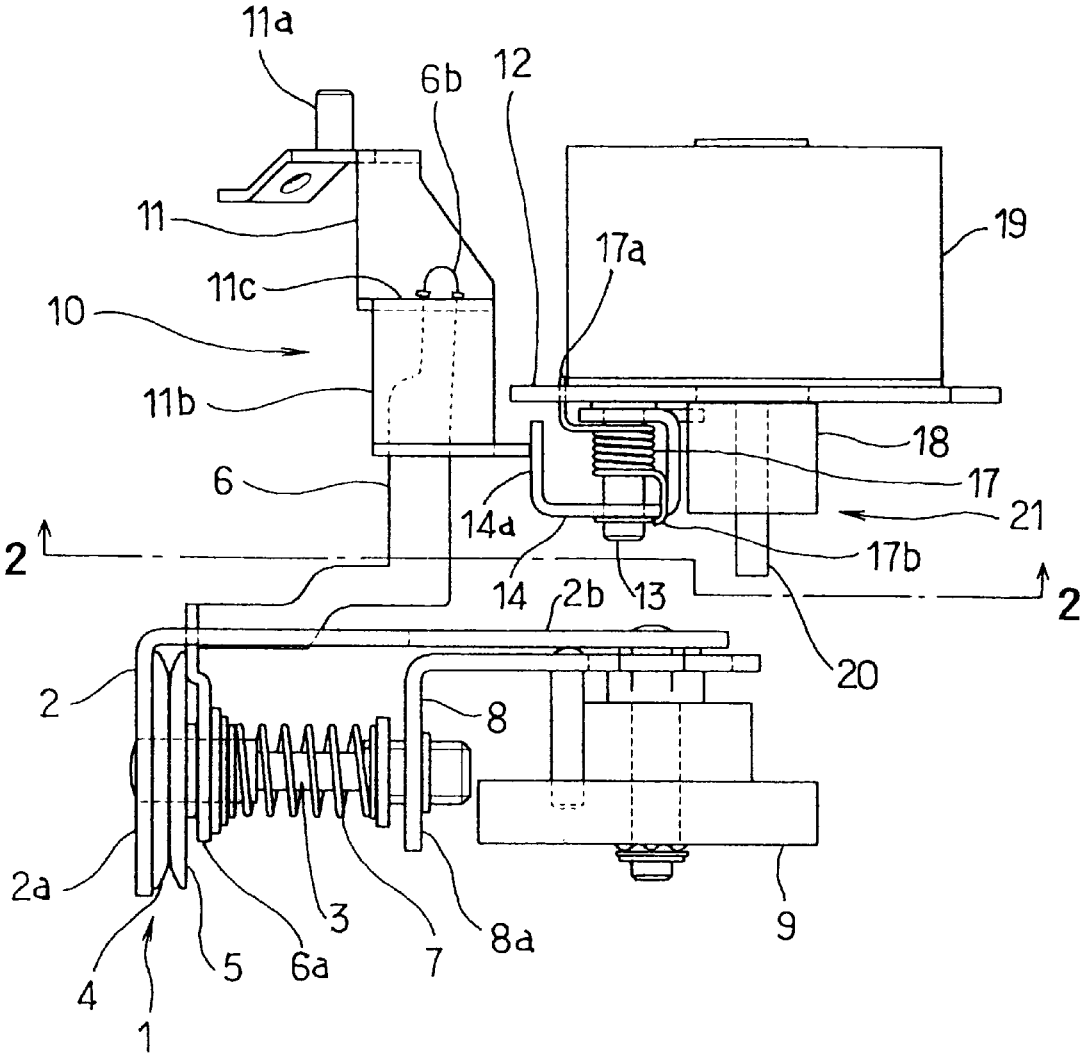
FIG. 1 is a top plan view of a thread tension applying mechanism and a thread tension releasing mechanism of a sewing machine of one embodiment in accordance with the present invention.

Referring now to FIG. 1, the thread tension applying mechanism 1 is provided for applying a predetermined tension to a needle thread (not shown) supplied from a bobbin (not shown) to the needle 36 secured to the lower end of the needle bar 35. The thread tension applying mechanism 1 includes a substantially L-shaped support plate 2 fixed to the sewing machine body 31. A left-hand end of a shaft 3 is mounted to a strip portion 2*a* of the support plate 2. The shaft 3 extends through holes of a pair of thread tension discs 4 and 5, a hole of a lower end 6*a* of a thread tension releasing plate 6, a thread tension spring 7 comprising a compression coil spring, and a hole of a strip portion 8*a* of a substantially L-shaped movable plate 8 in this order although none of the holes are shown. A thread tension dial 9 is rotatably mounted on a right-hand end of the other strip portion 2*b* of the support plate 2. The movable plate 8 in reciprocated leftward and rightward when the thread tension dial 9 is rotated clockwise and counterclockwise. An a result, a force the thread tension spring 7 applies to the thread tension disc 5 so as to press the latter against the other thread tension disc 4 is adjusted, so that a thread tension applied to the needle thread is adjusted. The aforesaid end 6*a* of the thread tension releasing plate 6 constitutes a releasing plate portion in the invention.

A thread tension releasing mechanism 10 is provided over the thread tension applying mechanism 1 in FIG. 1. The thread tension releasing mechanism 10 comprises the thread tension releasing plate 6, a pivot plate 11 pivoted about a shaft 11*a* (see FIG. 2) and a releasing lover 14 pivotally mounted on a shaft 13 further mounted on a base plate 12. The pivot plate 11 is formed substantially into an L-shape and is urged by a tension spring 15 so as to be pivoted clockwise in PIG. 2. The pivot plate 11 includes an upper end side stepped strip portion 11*b* formed with an engagement hole 11*d*. An upper end 6*b* of the thread tension releasing plate 6 is inserted through the engagement hole 11*d* to be engaged therewith so that the pivot plate 11 and the thread tension releasing plate 6 are connected together. Accordingly, the end 6*b* of the thread tension releasing plate 6 constitutes a connecting plate portion in the invention.

The pivot plate 11 has a lower end 11*e* linked to a lifting lever 16. The lifting lever 16 is a manually operable lever for upwardly moving a presser bar (not shown) with a lower end on which a presser foot (not shown) for pressing a piece of cloth is mounted. The lifting lever 16 is rotated about a shaft (not shown) inserted through a shaft support hole 16*a*. Upon pivot of the lifting lever 16, the presser bar is moved upward so that the presser foot is moved to an upper position.

Figure 2:
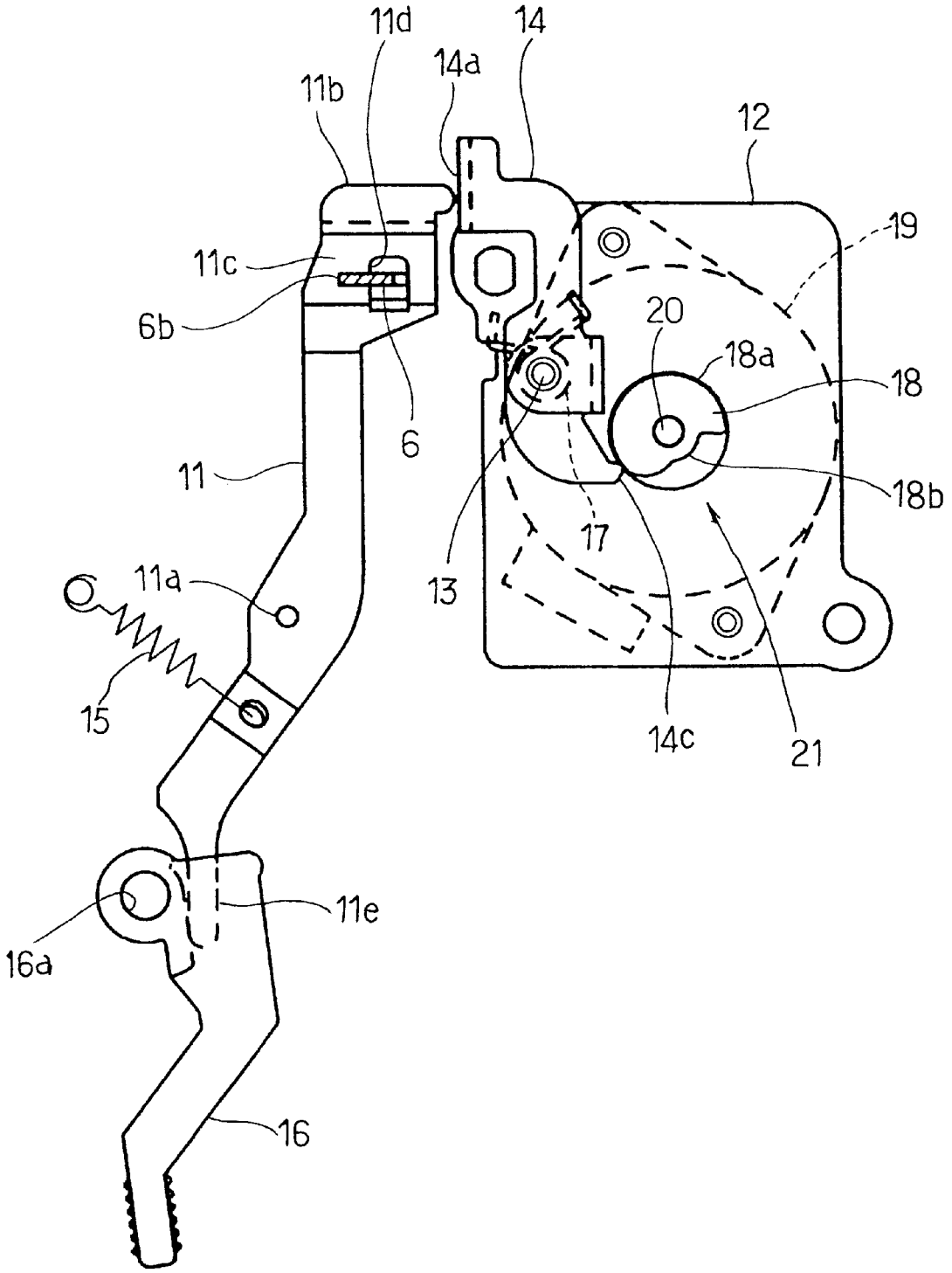
FIG. 2 is a longitudinal section taken along line 2—2 in FIG. 1.
Figure 6B:
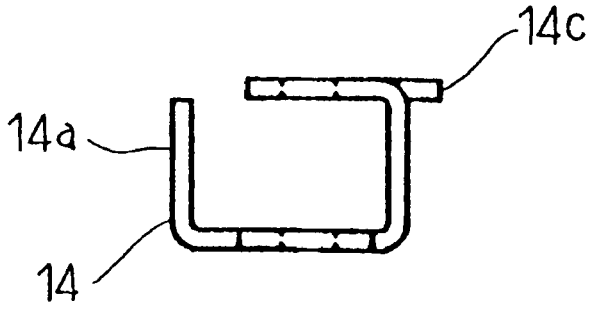
FIGS. 6A to 6C are front, top plan and side views of a releasing lever respectively.
Figure 6C:
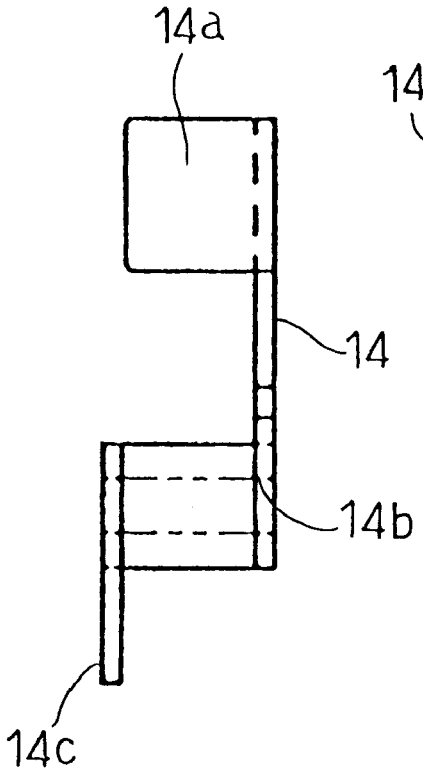
Figure 6A:
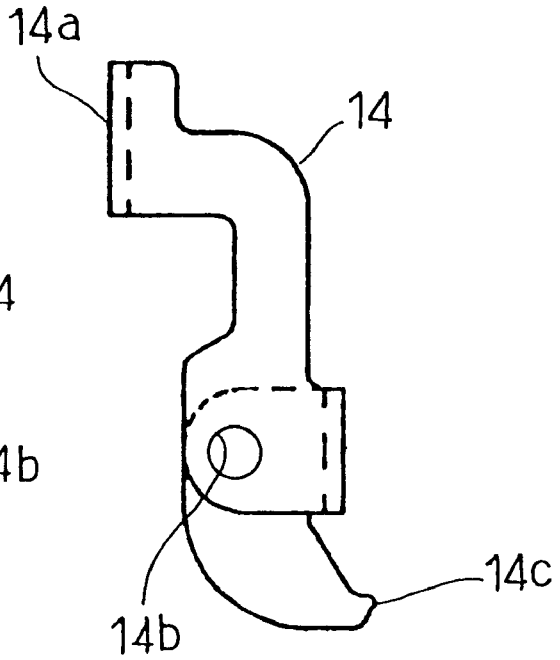

A distal end of the strip portion 11*b* of the pivot plate 11 is in abutment with an upper end 14*a* of the releasing lever 14 as viewed in FIG. 2. The releasing lever 14 is formed into such a shape as shown in FIGS. 6A to 6C. The releasing lever 14 has a through hole 14*b* formed in a middle portion thereof. The shaft 13 is inserted through the hole 14*b* so that the releasing lever 14 is pivoted about the shaft 13. A torsion coil spring 17 is disposed around the shaft 13, and has one end 17*a* fastened to the base plate 12 and the other end 17*b* fastened to the releasing lever 14. As a result, the releasing level 14 is urged to be rotated counterclockwise in FIG. 2 by the torsion coil spring 17. A left-hand end 14*a* of the releasing lever 14 is brought into abutment with the strip portion 11*b* of the pivot plate 11, and a distal lower end 14*c* of the releasing lever 14 is brought into contact with a cam face of a cam 18 which will be described later.

Figure 3:
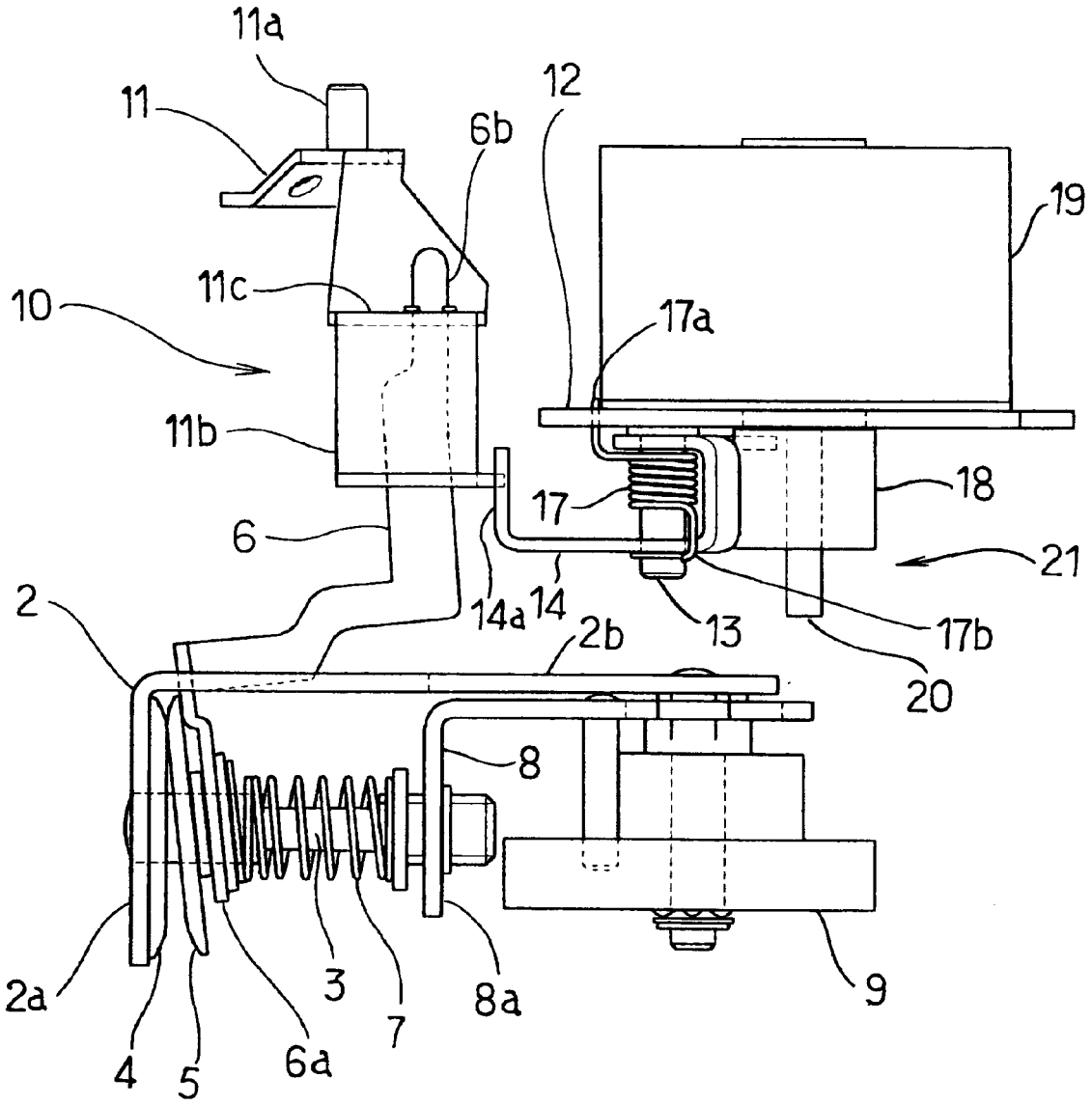
FIG. 3 is a view similar to FIG. 1, showing a state where the thread tension applying mechanism is released.
Figure 4:
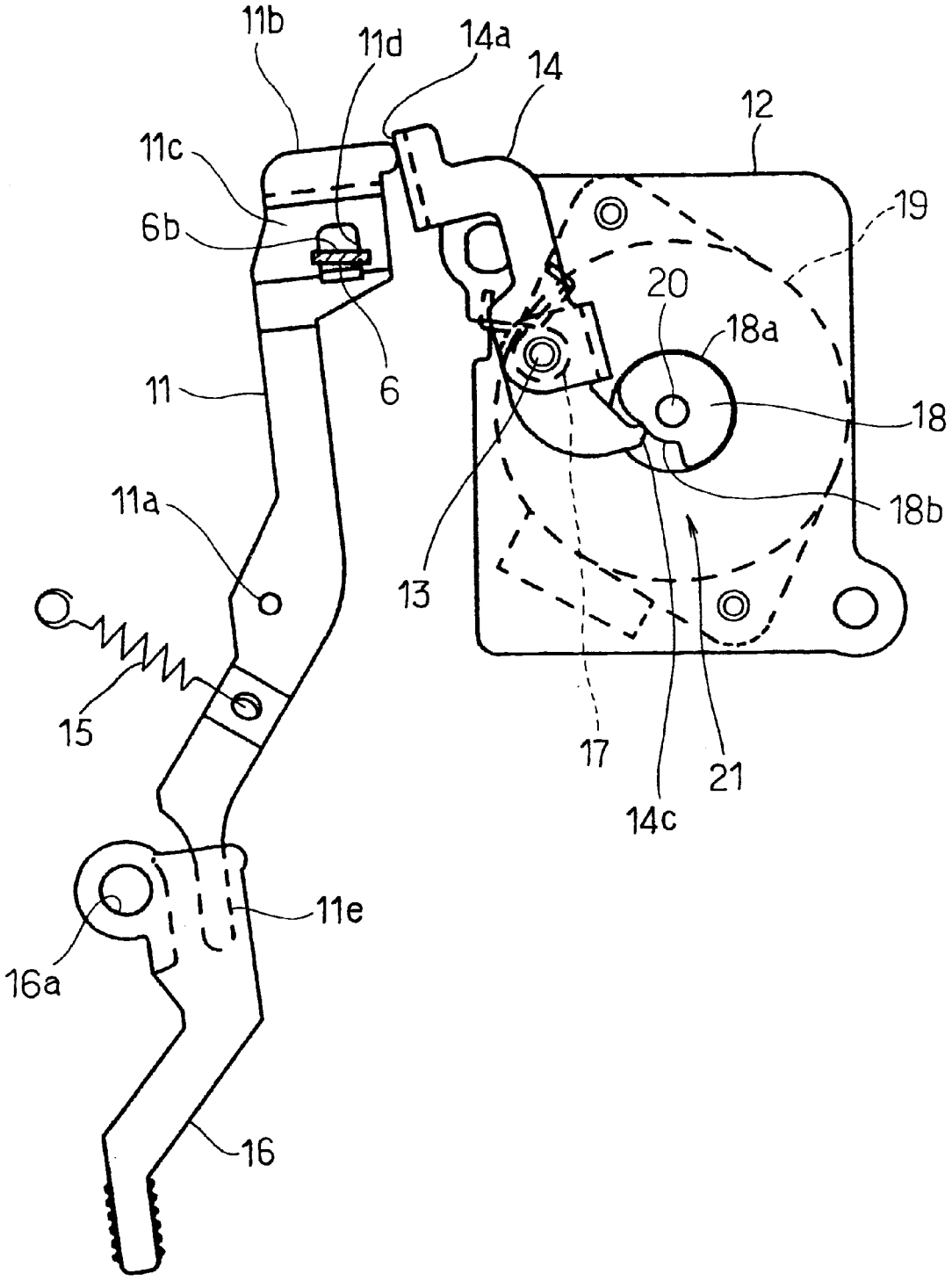
FIG. 4 is a view similar to FIG. 2, showing a state where the thread tension applying mechanism is released.

The pivot plate 11 is pivoted from a position shown in FIGS. 1 and 2 to a position shown in FIGS. 3 and 4 when the releasing lever 14 is pivoted from a position shown in FIG. 2 to a position shown in FIG. 4 by a spring force of the torsion coil spring 17. This pivotal movement of the pivot plate 11 displaces the thread tension releasing plate 6 from a position shown in FIG. 1 to a position shown in FIG. 3. The displacement of the releasing plate 6 parts the right-hand thread tension disc 5 from the left-hand thread tension disc 4 such that the thread tension applying mechanism 1 is released from a tension applying state. Accordingly, the torsion coil spring 17 constitutes a drive source (namely, an actuator) for driving the thread tension releasing mechanism 10.

An electric motor 19 such an a stepping motor is mounted on the upper side of the base plate 12 as viewed in FIG. 1. The motor 19 constitutes a drive source in the invention. The motor 19 includes a rotational shaft 20 extending through a hole (not shown) of the base plate 12 and projecting downward as viewed in FIG. 1. The cam 18 is mounted on the shaft 20 of the motor 19. When a distal end 14*c* of the releasing lever 14 is in contact with an outermost peripheral face 18*a* (cam face) of the cam 18, the thread tension discs 4 and 5 of the thread tension applying mechanism 1 are in engagement with each other or closed as shown in FIGS. 1 and 2. In this state, when the motor 19 is energized so that the cam 18 is rotated clockwise in FIG. 2, the distal end 14*c* of the releasing lever 14 is brought into contact with a depressed outer peripheral face 18*b* (cam face) of the cam 18 as shown in FIGS. 3 and 4, so that the spring force of the torsion coil spring 17 rotates the releasing lever 14 counterclockwise in FIG. 4. As a result, the left-hand end 14*b* of the releasing lever 14 pushes the strip portion 11*b* of the pivot plate 11 such that the pivot plate is pivoted counterclockwise in FIG. 4. Further, since the thread tension releasing plate 6 is displaced, the thread tension disc 5 is departed from the thread tension disc 4 so that the discs 4 and 5 of the thread tension applying mechanism 1 are opened.

The distal end 14*c* of the releasing lever 14 is re-brought into contact with the outermost peripheral face 18*a* of the cam 18 as shown in FIG. 2 when the motor 19 is energized to rotate the cam 18 clockwise with the thread tension applying mechanism 1 being in the open state as shown in FIGS. 3 and 4. As a result, the releasing lever 14 is rotated clockwise in FIG. 2 against the spring force of the torsion coil spring 17. Accordingly, the pivot plate 11 is pivoted clockwise in FIG. 4 and the thread tension releasing plate 6 returns to its former position, so that the discs 4 and 5 of the thread tension applying mechanism 1 are closed. The releasing lever 14 and the cam 18 constitute a switching mechanism 21 for switching the torsion coil spring 17 between an operative state as shown in FIGS. 3 and 4 and a non-operative state an shown in FIGS. 1 and 2. The motor 19 constitutes a drive source for driving the switching mechanism 21.

The motor 19 is used to close and open the thread tension applying mechanism 1 as the drive source for driving the switching mechanism 21, and also serves as a drive source for reciprocating the needle bar 35 leftward and rightward. Thus, the motor 19 serves as a drive source for rocking the needle 36 leftward and rightward. An arrangement for driving the needle rocking mechanism for reciprocating the needle bar 35 and accordingly the needle 36 leftward and rightward and the switching mechanism 21 by a single motor 19 is disclosed in Japanese patent application No. 11-33257 filed by the assignee of the present invention.

The arrangement disclosed in Japanese patent application No. 11-33257 will be described in brief. Referring to FIG. 7, the needle bar 35 is supported on a needle bar supporting member 37 so an to be moved upward and downward. The supporting member 37 is pivotable about a support shaft 38 and connected via a connecting member 39 to a sector gear 40 provided to be rotatable about a support shaft 41. The sector gear 40 has gear teeth formed in a range of about 80 degrees and in mesh engagement with a driving gear 42 mounted to the distal end of the shaft 20 of the motor 19. When the motor 19 is rotated in the normal and reverse directions, the sector gear 40 is rocked leftward and rightward so that the connecting member 39 and the supporting member 37 are accordingly rocked leftward and rightward. As a result, the needle bar 35 and the needle 36 are reciprocated leftward and rightward. The switching mechanism 21 is not driven by the motor 19 within the above-described needle rocking range. On the other hand, when the motor 19 is operated out of the needle rocking range, the switching mechanism 21 is operated as described above so that the thread tension releasing mechanism 1 is opened.

Figure 5:
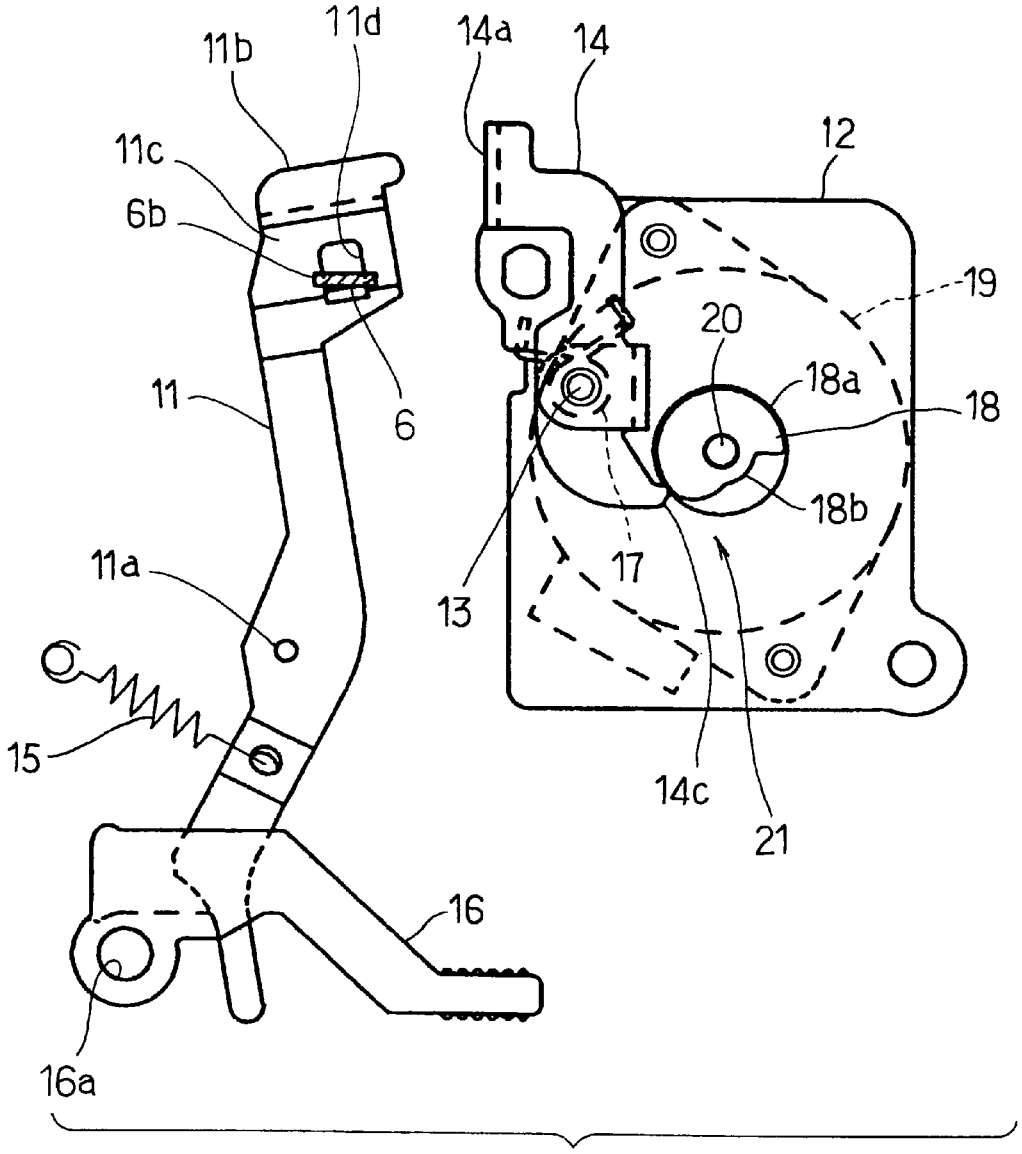
FIG. 5 is a view similar to FIG. 2, showing a state where a lifting lever is operated to release the thread tension applying mechanism.

The thread tension applying mechanism 1 can also be manually opened by the lifting lever 16. More specifically, the lifting lever 16 assuming the lower position as shown in FIG. 2, namely, in a state where the presser bar and the presser foot assume the respective lower positions is manually operated to be rotated upward as shown in FIG. 5 when the discs 4 and 5 of the thread tension applying mechanism 1 are closed. The pivot plate 11 is pivoted by the lifting lever 16 counterclockwise in FIG. 5. As a result, since the thread tension releasing plate 6 is displaced, the discs 4 and 5 of the thread tension applying mechanism 1 are opened. Further, the presser bar and the presser foot are moved to the respective upper limit positions when the lifting lever 16 is rotated upward.

According to the above-described construction of the embodiment, the torsion coil spring 17 is provided for driving the thread tension releasing mechanism 10. The switching mechanism 21 is provided for switching the torsion coil spring 17 between the operative state and the non-operative state. Further, the motor 19 is provided for driving the switching mechanism 21. Consequently, the motor 19 developing a small driving force can be used. More specifically, the thread tension releasing mechanism 10 comprises the thread tension releasing plate 6 and the pivot plate 11. Accordingly, the spring force of the torsion coil spring 17 driving the thread tension releasing mechanism 10 can be rendered smaller than the spring force of the thread tension coil spring 7 of the thread tension applying mechanism 1. The switching mechanism 21 switching the torsion coil spring 17 between the operative and non-operative states comprises the releasing lever 14 and the cam 18. As the result of this construction, the driving force of the motor 19 driving the switching mechanism 21 is rendered smaller than that of the motor in the conventional construction. The reason for this is that the cam and the lever are used to reduce the driving force at two stages. Consequently, the size of the motor 19 can be reduced and accordingly, the size of the sewing machine can be reduced.

In the case of the embroidery machine as described above, a tension applied to the needle thread is usually set to a small value when the embroidery sewing is carried out. A required driving force in small when the thread tension applying mechanism 1 in which the thread tension is set to the small value is opened. Consequently, a motor developing a further small driving force can be used as the motor 19 driving the switching mechanism 21 for the torsion coil spring 17 with the small spring force.

Further, the motor 19 can be rotated smoothly upon energization even if the thread tension of the thread tension applying mechanism 1 has been set to a large value for some reason or other. The reason for this is that the spring force of the torsion coil spring 17 is constant. Accordingly, the loss of synchronism of the motor 19 can reliably be prevented when the motor 19 is also used am the drive source for needle rocking. In the above-described construction, the spring force of the torsion coil spring 17 is so small that the thread tension applying mechanism 1 cannot sometimes be opened. However, there is no problem in the specification of the sewing machine.

The driving force of the motor is used to open the thread tension applying mechanism also in the prior art. In the prior art construction, however, when the set thread tension is too high or strong, the motor cannot sometimes be rotated smoothly. This results in the lose of synchronism of the motor. Further, in the prior art, the driving force of the motor needs to be set so as to correspond to a settable maximum thread tension in order that the loss of synchronism of the motor may be prevented. This increases the size of the motor. However, the above-described construction of the embodiment can overcome this problem of the prior art.

The thread tension releasing mechanism 10 comprises the pivot plate 11 pivoted in the releasing direction by the torsion coil spring 17 and the thread tension releasing plate 6 linked to the pivot plate 11 so as to open the thread tension applying mechanism 1 upon pivot of the plate 11. Consequently, the construction of the thread tension releasing mechanism 10 can be simplified. Further, the end **6*b* of the releasing plate 6 is inserted through the hole 11*d* of the end 11*b* of the pivot plate 11 so that the pivot plate 11 and the releasing plate 6 are connected together. This construction can reliably connects the pivot plate 11 and the releasing plate 6 together and can prevent disconnection of the plates 11 and 6**. Moreover, these plates can easily be assembled.

The thread tension releasing plate 6 is constructed of a single plate-shaped member. More specifically, the releasing plate 6 includes the opening plate portion or the end **6*a* brought into abutment with the disc 5 of the thread tension applying mechanism 10 to displace the disc and connecting plate portion or the end 6*b* connected to the pivot plate 11**, these plate portions being formed integrally. Consequently, the number of parts can be rendered smaller than the case where the opening plate portion and the connecting plate portion are discrete, and the assembly of these parts can be reduced.

Although the motor 19 is proved as the drive source for driving the switching mechanism 21 in the foregoing embodiment, a rotary solenoid may be used, instead.

Further, although the invention in applied to the domestic embroidery machine in the foregoing embodiment, the invention may be applied to sewing machines for both the domestic use and the industrial use which perform zigzag stitches or straight stitches.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A sewing machine comprising:

a thread tension applying mechanism for applying a predetermined tension to a needle thread supplied from a needle thread supply source to a sewing needle;

a thread tension releasing mechanism for releasing the thread tension applying mechanism from a tension applying state;

a spring for driving the thread tension releasing mechanism;

a switching mechanism for switching the spring between an operative state and a non-operative state; and a drive source for driving the switching mechanism.

2. A sewing machine according to claim 1, wherein the drive source comprises an electric motor or a rotary solenoid.

3. A sewing machine according to claim 1, wherein the spring is rotatable and the thread tension releasing mechanism comprises a pivot plate pivoted in a releasing direction by the spring and a releasing plate provided to be linked with the pivot plate so as to release the thread tension applying mechanism when the pivot plate is pivoted.

4. A sewing machine according to claim 3, wherein the pivot plate has an end formed with a hole and the releasing plate has an end inserted through the hole of the pivot plate so that the releasing plate is connected to the pivot plate.

5. A sewing machine according to claim 3, wherein the thread tension applying mechanism comprises at least a pair of thread tension discs and the releasing plate includes a releasing plate portion brought into abutment with one of the thread tension discs to displace said one thread tension disc so that the thread tension applying mechanism is released and a connected plate portion connected to the pivot plate, the releasing plate portion and the connected plate portion being formed integrally with each other.

6. A sewing machine according to claim 3, wherein the switching mechanism comprises a releasing lever linked with the pivot plate and a cam brought into contact with the releasing lever and driven by the drive source.

7. A sewing machine according to claim 4, wherein the thread tension applying mechanism comprise a pair of thread tension discs and the releasing plate includes a releasing plate portion brought into abutment with one of the thread tension discs to displace said one thread tension disc so that the thread tension applying mechanism is released and a connected plate portion connected to the pivot plate, the releasing plate portion and the connected plate portion being formed integrally with each other.

8. A sewing machine according to claim 1, wherein an embroidering function or a function of performing a normal stitch or a zigzag stitch is selectively executed.

9. A sewing machine according to claim 1, wherein the drive source serves as a drive source for rocking the sewing needle rightward and leftward.

10. A sewing machine according to claim 1, further comprising a lifting lever manually operated so that a presser foot pressing a piece of cloth is moved upward, and wherein the thread tension releasing mechanism is driven in synchronization with an operation of the lifting lever.

* * * * *